US008175507B2

(12) United States Patent
Wing

(10) Patent No.: US 8,175,507 B2
(45) Date of Patent: May 8, 2012

(54) TRANSFER BELT LATERAL POSITION CONTROL APPARATUS AND METHOD

(75) Inventor: Joseph M. Wing, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 522 days.

(21) Appl. No.: 12/415,321

(22) Filed: Mar. 31, 2009

(65) Prior Publication Data

US 2010/0247167 A1 Sep. 30, 2010

(51) Int. Cl.
*G03G 15/16* (2006.01)

(52) U.S. Cl. ..... 399/302; 198/807; 198/810.01; 399/165; 399/303; 399/308

(58) Field of Classification Search ..... 399/165, 399/303, 313, 302, 308; 198/806, 807, 810.01, 198/810.03
See application file for complete search history.

(56) References Cited

U.S. PATENT DOCUMENTS

| | | | | |
|---|---|---|---|---|
| 5,510,877 | A | 4/1996 | deJong et al. | |
| 6,195,518 | B1 | 2/2001 | Bennett et al. | |
| 6,349,192 | B1 | 2/2002 | Yoshino et al. | |
| 6,721,528 | B1 * | 4/2004 | Schreieder et al. | 399/302 |
| 6,904,255 | B2 | 6/2005 | Kera et al. | |
| 7,177,585 | B2 | 2/2007 | Matsuzaka et al. | |
| 2002/0034400 | A1 * | 3/2002 | Asuwa et al. | 399/165 |
| 2003/0136646 | A1 * | 7/2003 | Powell | 198/807 |
| 2005/0158076 | A1 * | 7/2005 | Pichlmeier et al. | 399/165 |
| 2008/0019736 | A1 * | 1/2008 | Ryo et al. | 399/165 |
| 2009/0087231 | A1 * | 4/2009 | Masaki et al. | 399/308 |
| 2009/0180805 | A1 * | 7/2009 | Nakura et al. | 399/165 |

* cited by examiner

*Primary Examiner* — Sophia S Chen
(74) *Attorney, Agent, or Firm* — Hoffmann & Baron, LLP

(57) ABSTRACT

According to aspects described herein, there is disclosed an apparatus and method for controlling a position of a belt in a printing system. The apparatus including a roller assembly for engaging at least a portion of a belt, a pair of laterally spaced support arms and an actuating assembly for pivotally moving at least one support arm. The belt being generally moveable in a process flow direction within the printing system, wherein a lateral direction extends substantially along the belt and substantially perpendicular to the process flow direction. The roller assembly extending laterally across the belt. The pair of laterally spaced support arms each rotatably supporting opposed ends of the roller assembly. Each support arm being pivotally coupled to the printing system for movement about a pivot axis extending substantially in the lateral direction. The pivotal movement pivoting one support arm relative to the other.

18 Claims, 3 Drawing Sheets

TRANSFER BELT LATERAL POSITION CONTROL APPARATUS AND METHOD

TECHNICAL FIELD

The presently disclosed technologies are directed to controlling and/or adjusting the lateral position of an image handling belt in a printing system. In particular, it is directed to an apparatus and method for belt steering and control.

BACKGROUND

In general, conventional image forming apparatus such as copiers and laser printers employing an electrophotographic system or electrostatic recording system as described above have a configuration in which image exposure is performed on a surface of a photosensitive drum to form an electrostatic latent image; the electrostatic latent image formed on the surface of the photosensitive drum is developed by a developing device to form a toner image in a predetermined color, and the toner image is directly transferred on to and fixed on recording paper or temporarily transferred to an intermediate transfer body and is thereafter transferred on to the recording paper at a time to form an image.

An example of a conventional image forming apparatus is shown in U.S. Pat. No. 6,349,192 to Yoshino et al. In such apparatus, when a color image is formed by an image forming apparatus 500, as shown in FIG. 5 herein, a configuration may be employed in which a latent image forming step of performing image exposure on a surface of a single photosensitive drum 300 with an image exposure device 301 to form an electrostatic latent image associated with a predetermined color and a developing step of developing the latent image with a developing device for the associated color are repeated for a predetermined number of colors; toner images having the predetermined colors sequentially formed on the surface of the photosensitive drum are subjected to primary transfer onto an intermediate transfer belt on a multiplex basis; and the toner images are subjected to secondary transfer from the intermediate transfer belt on to a substrate media at a time to form a color image.

Image forming apparatus include so-called tandem type image forming apparatus having plural (e.g., four) photosensitive drums each associated with a predetermined color and having a configuration in which toner images in predetermined colors sequentially formed on surfaces of the respective photosensitive drums are subjected to primary transfer on to an intermediate transfer belt 2 on a multiplex basis; and the toner images are thereafter subjected to secondary transfer from the intermediate transfer belt on to a substrate media 7 at a time to form a color image. For example, FIG. 5 shows a tandem type image forming apparatus having four image forming units 300, i.e., individual forming units for colors such as black (K), yellow (Y), magenta (M) and cyan (C). The four image forming units 300 are horizontally arranged at constant intervals from each other. Below the image forming units for the colors, an intermediate transfer belt 2 for transferring toner images sequentially formed by the respective image forming units in an overlapping relationship with each other is provided such that it is driven by plural rolls 200-203 including driving rolls for rotation in the direction indicated by the arrow. For example, the intermediate transfer belt 2 is configured in the form of an endless belt by forming a synthetic resin film made of polyimide or the like having flexibility in the form of a belt and by connecting both ends of the synthetic resin film formed in a belt-like configuration by means of welding or the like.

In printing systems, transfer belts are also used to handle and/or transfer substrate media as well as the images for transfer to the substrate media. Thus, an image can be transferred after being deposited on a substrate media. As with the intermediate transfer belts described above, such substrate media transfer belts 3 move along a travel path in a process direction and are supported by various rollers or support shoes intended to maintain the belts in position. However, sometimes due to heavy usage, poor belt conicity or hardware misalignments the belts can slide or shift laterally on the rollers that drive them. Such lateral movement can lead to belt walk-off, where the belt comes off the rollers, which can in-turn lead to operating delays as well as possible damage to the belt, substrate media or the system itself.

In certain printing systems that use transfer belts, edge guides are used to limit lateral movement. However due to extensive usage and the fragile nature of the belts, edge guides can compromise the integrity of the belt as well. Alternatively, belt edge detectors are employed to track lateral belt movement and potentially shut-down the system before the belt walks off a roller. While belt edge detectors are helpful in preventing damage to the belt or the system, they do not automatically correct the improper belt position. Also, the manual adjustment or re-adjustment of a belt or the belt roller pitch can be time consuming and negatively effect production deadlines.

Accordingly, it would be desirable to provide an apparatus or method of controlling and/or adjusting the lateral position of one or more belts in a printing system in order to avoid processing interruptions or delays, damage to the system or substrate media and other shortcomings of the prior art.

SUMMARY

According to aspects described herein, there is disclosed an apparatus for controlling a belt position in a printing system. The apparatus including a roller assembly for engaging at least a portion of a belt, a pair of laterally spaced support arms and an actuating assembly for pivotally moving at least one support arm. The belt being generally moveable in a process flow direction within the printing system, wherein a lateral direction extends substantially along the belt and substantially perpendicular to the process flow direction. The roller assembly extending laterally across the belt. The pair of laterally spaced support arms each rotatably supporting opposed ends of the roller assembly. Each support arm being pivotally coupled to the printing system for movement about a pivot axis extending substantially in the lateral direction. The pivotal movement pivoting one support arm relative to the other.

According to other aspects described herein, the actuating assembly can include at least one rotatable cam. The cam can engage a rotatable bearing member removeably secured to the support arm. Also, the actuating assembly can pivot both support arms in opposite directions about the pivot axis. Further, Each of the support arms can be engaged by a cam, where the cams have an opposite profile to one another. The cams can be mutually secured to the same rotatable cam shaft. Also, the cams can be actuated independent of one another. Further, the at least one support arm pivotally movable by the actuating assembly can be biased toward engagement with the actuating assembly. Additionally, the support arms can each include at least one mounting slot for receiving a fastener to secure each support arm to the printing system. The mounting slot can passing through the support arm. The actuating assembly can further include a tensioning assembly for adjustably translating a longitudinal axis of the roller assembly toward or away from the pivot axis.

According to other aspects described herein, there is disclosed an apparatus for controlling a position of a transfer belt in a printing system. The transfer belt for handling one or more images and/or a substrate media in a printing system. The belt being generally moveable in a process flow direction within the printing system, wherein a lateral direction extends substantially along the belt and substantially perpendicular to the process flow direction; a roller assembly for engaging at least a portion of the belt, the roller assembly extending laterally across the belt; a pair of laterally spaced support arms each supporting opposed ends of the roller assembly, each support arm being pivotally supported allowing pivotal movement about a pivot axis extending substantially in the lateral direction; and a pair of rotating cams, each cam engaged with a portion of one of the support arms for pivotally moving the support arms, whereby rotation of the cams pivots at least one support arm relative to the other.

According to other aspects described herein, the apparatus further can include a motor assembly drivingly coupled to the pair of rotating cams for rotating the cams. The motor assembly can selectively rotate the cams in one of two directions.

According to other aspects described herein, there is disclosed a method of controlling a belt position in a printing system. The method including detecting a threshold condition associated with at least one edge of the belt. Also, the method including actuating at least one of two laterally spaced support arms for changing the lateral belt position. The support arms each supporting opposed ends of a roller assembly for engaging at least a portion of the belt. Each of the support arms being pivotally supported allowing pivotal movement about an axis extending in a lateral direction. The actuation causing pivotal movement of at least one support arm, whereby the pivotal movement rotates one support arm relative to the other and tilts the roller assembly.

According to other aspects described herein, the actuating of the at least one of two laterally spaced support arms can include both support arms. Also, the threshold condition can be determined from the output of a belt edge sensor. Additionally, the method can further include shutting down at least a portion of the printing system in response to the threshold condition reaching a fail-safe value. Further, the method can include storing a parameter associated with a tilt position of the roller assembly, a position of a drive motor and/or a configuration of the actuating assembly. Further still, the method can include further actuating the at least one of two laterally spaced support arms, whereby at least one support arm is pivotally moved into a position associated with the stored parameter.

DETAILED DESCRIPTION

Figure 1:
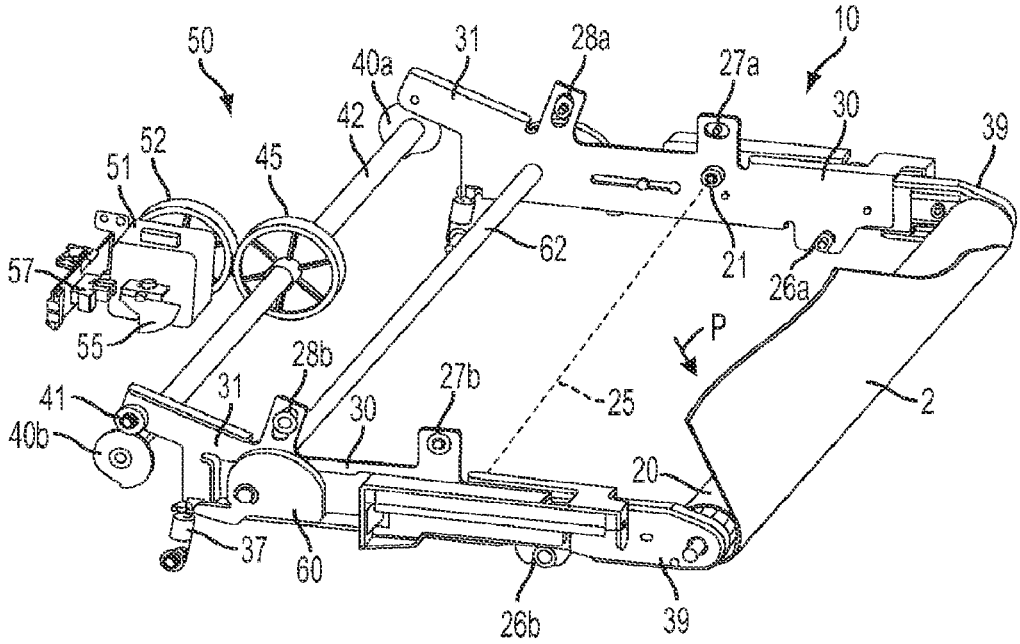
FIG. 1 is an inboard side top perspective view of a belt position control apparatus, showing a cut-away portion of a transfer belt, in accordance with an aspect of the disclosed technologies.

Describing now in further detail these exemplary embodiments with reference to the Figures. A transfer belt position control apparatus and method is preferably used in a select location or locations of an image and/or substrate media path or paths of various conventional printing assemblies. Thus, a portion of an exemplary printing system image intermediate transfer belt path is illustrated herein, in particular a modular portion including an image handling assembly.

As used herein, a "printer" or "printing system" refers to one or more devices used to generate "printouts" or a print outputting function, which refers to the reproduction of information on "substrate media" for any purpose. A "printer" or "printing system" as used herein encompasses any apparatus or portion thereof, such as a digital and/or analog copier, bookmaking machine, facsimile machine, multi-function machine, etc. which performs a print outputting function.

A printing system can use an "electrostatographic process" to generate printouts, which refers to forming and using electrostatic charged patterns to record and reproduce information, a "xerographic process", which refers to the use of a resinous powder, such as toner, on an electrically charged plate, roller or belt and reproduce information, or other suitable processes for generating printouts, such as an ink jet process, a liquid ink process, a solid ink process, and the like. Also, such a printing system can print and/or handle either monochrome or color image data.

As used herein, "substrate media" refers to, for example, paper, transparencies, parchment, film, fabric, plastic, or other substrates on which information can be reproduced, preferably in the form of a sheet or web.

As used herein, "image transfer belt", "media transfer belt", "transfer belt" or "belt" refer to, for example, an elongated flexible web supported for movement along a process flow direction. For example, an image transfer belt is capable of conveying an image in the form of toner for transfer to a substrate media. Another example includes a media transfer belt, which preferably engages and/or carries a substrate media within a printing system. Such belts can be endless belts, looping around on themselves within the printing system in order to continuously operate. Accordingly, belts move in a process flow path around a loop in which they circulate. A belt will engage a substrate media and/or carry an image thereon over at least a portion of the loop. Image transfer belts for carrying an image or portions thereof can include non-stretchable electrostatic or photoreceptor belts capable of accumulating toner thereon.

As used herein, "roller" or "steering roller" refer to a rotatably supported generally cylindrical member for directly engaging a belt. A "roller assembly" includes a roller or steering roller as well as additional support structure that allow the rollers to operate as desired. Rollers include rotating cylinders, as well as driven elements, journalled on bearings and a shaft.

As used herein, "sensor" refers to a device that responds to a physical stimulus and transmits a resulting impulse for the measurement and/or operation of controls. Such sensors include those that use pressure, light, motion, heat, sound and magnetism. Also, each of such sensors as refers to herein can include one or more point sensors and/or array sensors for detecting and/or measuring characteristics of a belt, image or substrate media, such as speed, orientation, process or cross-process position. Thus, reference herein to a "sensor" can include more than one sensor.

As used herein, "actuating assembly" refers to any mechanism and/or control system used to move elements in or around the system. In particular, a control system driving a motor, gears, a cam shaft and/or cams for engaging and moving other elements are part of an actuating assembly.

As used herein, the terms "process," "process direction" and "process flow direction" refer to a process of printing or reproducing information on substrate media. The process direction or process flow direction is a flow path in which a belt moves as part of the system in order to convey an image and/or a substrate media from one location to another within the printing system. A "cross-process direction" is generally lateral to the process direction.

Figure 2:
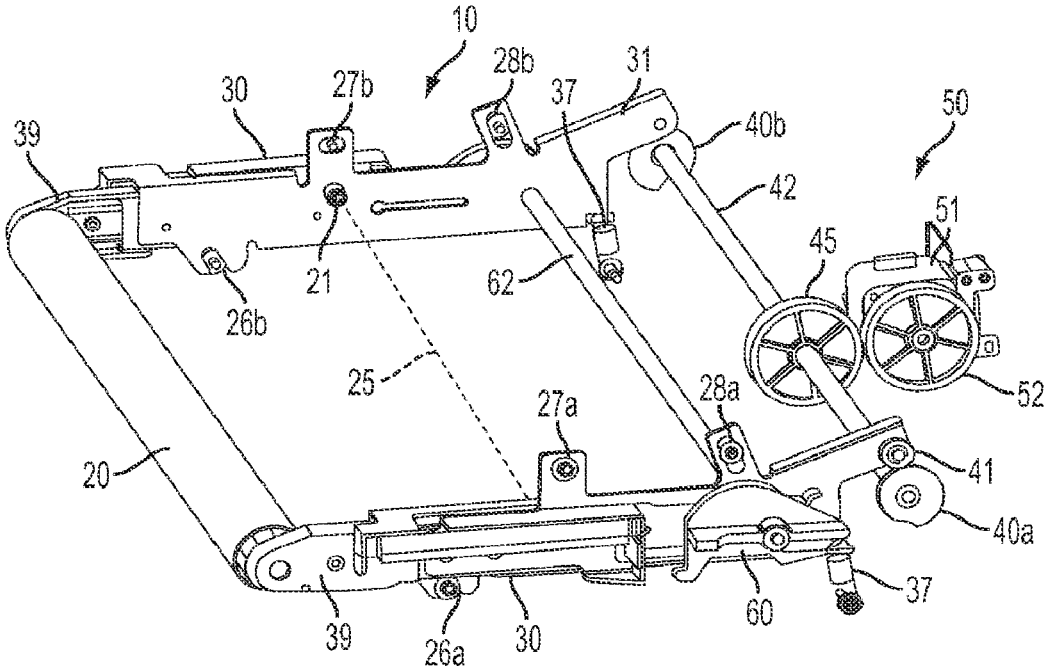
FIG. 2 is an outboard top perspective view of the belt position control apparatus of FIG. 1, with the transfer belt removed.

FIGS. 1 and 2 show inboard and outboard perspective views, respectively, of a belt position control apparatus 10 in accordance with an aspect of the disclosed technologies. The embodiments illustrated herein are particularly suited for a printing system that uses an intermediate image transfer belt for receiving and transporting the developed image. Preferably, an image is formed by collecting toner or other resinous powder into electrostatic charged patterns and transferred to an electrostatically charged belt that holds the powder in the pattern. Generally, the image is transferred to the image transfer belt from an electrostatically charged drum. The image transfer belt then transports the image to a subsequent transfer station/area were the image is transferred to a substrate media. Thereafter, the substrate media holding the transferred image can be further transported for fusing the image to the substrate media or further processing of the image and/or the substrate media. It should be understood that a belt position control apparatus 10 in accordance with the disclosed technologies herein can also be used for a media transfer belt that directly conveys substrate media.

As shown in FIG. 1, in operation a belt 2 moves generally in a process direction P, supported by and engaged with a number of rollers, such as steering roller 20. The steering roller 20 is part of a roller assembly of the belt position control apparatus 10. The rollers, and particularly steering roller 20, are preferably cylindrical or at least generally cylindrical and rotatably supported at opposed ends by support elements. The rollers generally extend laterally to the process direction and are adapted to rotate in the process direction. Opposed inboard and outboard edges of the belt 2 are generally disposed at or substantially near opposed ends of the rollers. For example, the belt 2 is preferably 10-12 mm smaller than the rollers to maintain a 5-6 mm spacing between the lateral edges of the belt 2 and the ends of the rollers.

A pair of support arms 30 are laterally spaced at opposed ends of the steering roller 20. A roller support end 39 of each support arm 30 acts as a yoke to rotatably support the steering roller 20. From the roller support end 39, the support arms 30 extend away from the steering roller 20, preferably toward an actuating assembly 50. The actuating assembly 50 can be disposed at the opposed end 31 of each support arm 30. Each of the support arms 30 is pivotally coupled to the printing system in which it is used by a post and bearing assembly 21. Thus, a line connecting the two opposed post and bearing assemblies 21 defines a pivot axis 25 for the belt position control apparatus 10. Additionally, the belt position control apparatus 10 is preferably secured to the printing system by additional stand-off fasteners. Each fastener secures to the printing system through oversized slots 26*a*, 27*a*, 28*a*, 26*b*, 27*b*, 28*b* in the support arms 30. The slots 26*a*, 27*a*, 28*a*, 26*b*, 27*b*, 28*b* allow for limited pivotal movement of the support arms 30. relative to the stand-off fasteners, while also providing stability to the apparatus 10. For ease of assembly, some of the slots, such as slots 26*a*, 26*b*, can have an open end. It should be understood that fewer or greater stand-off fasteners with corresponding fewer or greater slots could be provided. Alternatively, the bearing assemblies 21 could be designed to provide enough support to minimize or eliminate the need for stand-off fasteners and slots.

Preferably, at the opposite end of the support arms 30, from the steering roller 20, is the actuating assembly 50. The actuating assembly preferably includes a pair of cams 40*a*, 40*b* that engage the ends 31 of support arms 30. Preferably, the support arm ends 31 are each provided with a bearing washer 41, which is rotatably supported on a fixed post laterally projecting from the support arm ends 31. The cams 40*a*, 40*b* each engage one of the bearing washers 41 to actuate the support arm ends 31. Also, the cams 40*a*, 40*b* are both secured to a cam shaft 42. The cam shaft 42 is preferably rotationally supported for selective bi-directional rotation and includes a fixedly secured cam gear 45. Rotation of the cam shaft 42 will rotate both cams 40*a*, 40*b*, which in-turn will actuate the support arm ends 31 via the bearing washers 41. Preferably, the outboard cam 40*a* has the same rise/degree as the inboard cam 40*b*, but the profile with respect to how the cams 40*a*, 40*b* each engage the bearing washers 41 is opposite. Thus, as the cam shaft 42 and cams 40*a*, 40*b* rotate, each support arm end 31 will pivot in an opposite direction. In this way for example, when the cam shaft 42 rotates such that the support arm end 31 on the outboard side pivots in a clockwise direction (0.02 mm/degree), the support arm end on the inboard side preferably pivots in a counter-clockwise direction the same amount, and vise-versa. The size of the bearing washer 41 can also be changed to provide a greater or lesser degree of pivot of the support arms 30. Alternatively, the rise, degree, size or shape of the cams 40*a*, 40*b* could be changed not only to change the degree of pivot angle, but also to change the pitch of the cam profile. It should be understood that the particular profile of the pair of cams 40*a*, 40*b* can be designed to suit the particular rate at which the support arms 30 and the steering roller 20 should tilt. Additionally, the support arms 30 can be biased against the cams 40*a*, 40*b* via springs 37 or other biasing mechanisms. As yet a further alternative, the actuating assembly 50 could employ a direct gear linkage to activate the pivotal movement of the support arms 30.

As the support arms 30 are made to pivot by the actuating assembly 50, so too roller support ends 39 are made to pivot opposite from one another. Preferably, the support arms 30 are made to pivot in an equal but opposite direction. Thus, the axis of the steering roller 20 will tilt relative to the overall belt position control apparatus 10. For example, in a neutral position the axis of the steering roller 20 could be parallel to the pivot axis 25, but after the actuating assembly tilts the steering roller 20 they would no longer be parallel. Thus, the steering roller 20 is made to pivot about a virtual axis perpendicular to its own longitudinal axis.

The actuating assembly 50 is preferably run by a control system (not shown) that activates the drive motor 51. Preferably, the bi-directional drive motor 51 includes a motor gear 52 that engages cam gear 45. It should be understood that while gears 52, 45 are illustrated as smooth wheels, that they are preferably formed as toothed gears. Alternatively, the gears 52, 45 could be replaced with a wheel and belt/chain configuration. Regardless, activation of the drive motor 51 rotates the gears 52, 45, cam shaft 42, both cams 40*a*, 40*b* and the intervening members in order to pivot the steering roller 20. In order to maintain calibration and control of the drive motor 51, elements such as a home position flag 55 or sensor 57 can be provided.

Additionally, other elements such as a tensioning member 60 can be incorporated into the belt position steering control apparatus of the presently disclosed technologies. For example, rotation of tensioning member 60 can be made to retract steering roller 20 toward the pivot axis 25. Such a mechanism can be provided to adjust or more easily install a flexible but non-stretchable belt 2. Also, the tensioning member 60 can be coupled to the opposite side of the apparatus through tensioning axle 62, in order to control the steering roller 20 symmetrically. It should be understood that preferably the tensioning axle 62 is sized to loosely pass through both support arms 30. In this way, the tensioning axle 62 does not limit or retard the relative pivotal movement that should occur between the support arms 30.

Figure 3:
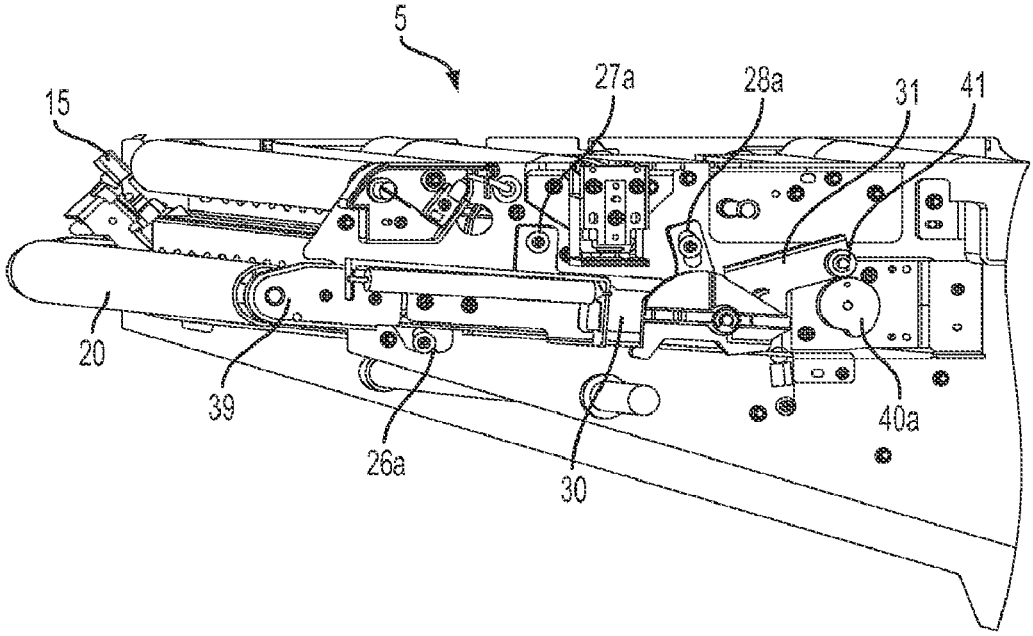
FIG. 3 is an outboard side perspective view of a cut-away portion of a printing system including an image transfer module with the transfer belt removed, including the apparatus for controlling belt position of FIG. 2.

FIG. 3 shows the belt position control apparatus 10 installed in a part of a printing system 5. In particular, this embodiment shows an image intermediate transfer belt module with the transfer belt removed. Although not visible in this figure, the internal post and bearing assemblies 21 provide a pivot axis 25 for the support arms 30. The fasteners and slots 26*a*, 27*a*, 28*a* are visible, with the fasteners fixedly secured to the printing system 5. It should be understood that the slots 26*a*, 27*a*, 28*a* (as well as opposed slots 26*b*, 27*b*, 28*b*) should be large enough to allow the proper range of pivoting for the support arms 30.

Figure 4:
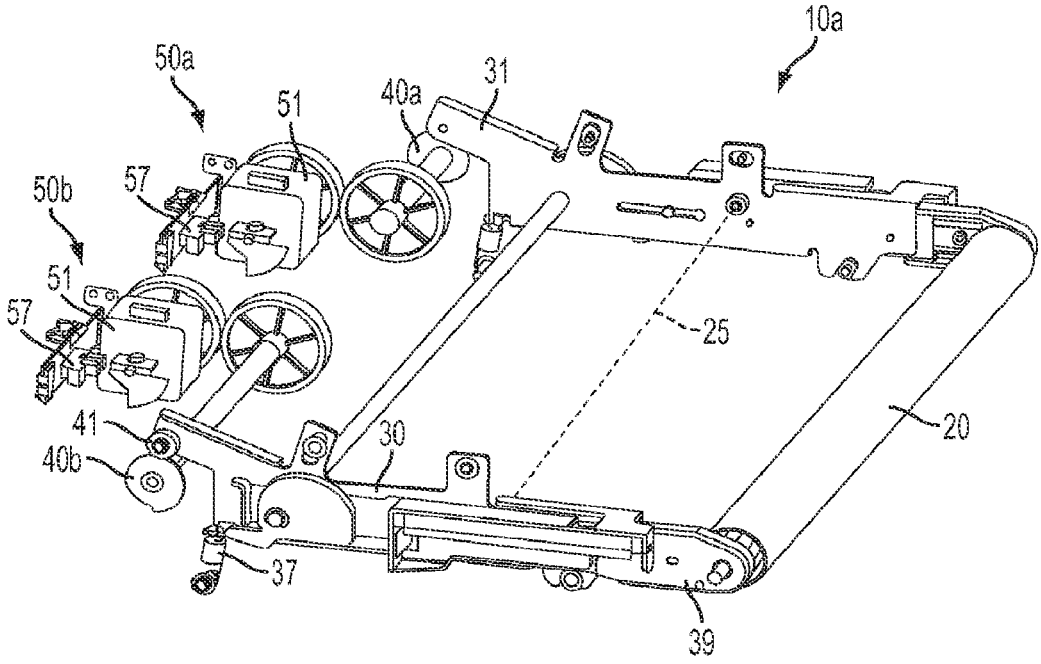
FIG. 4 is an inboard top perspective view of an alternative belt position control apparatus in accordance with an aspect of the disclosed technologies.
Figure 5:
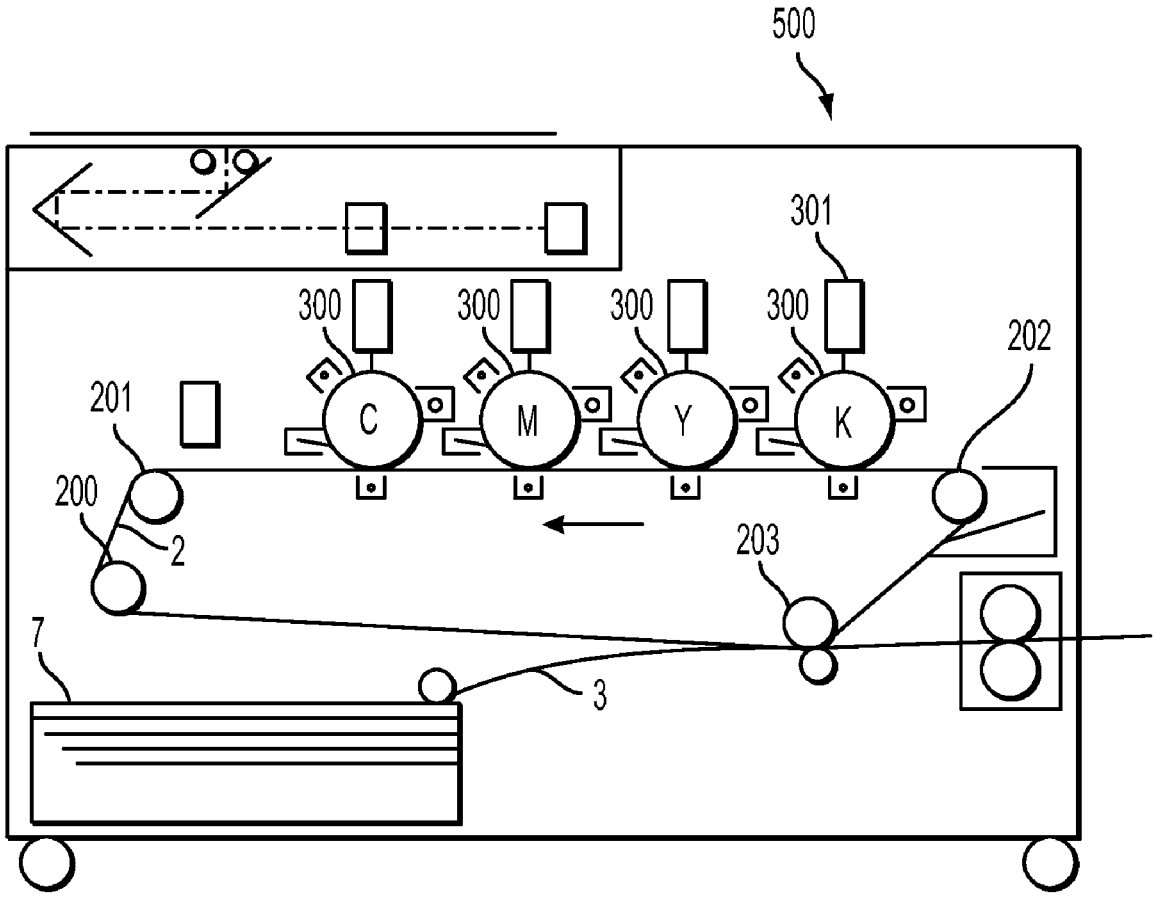
FIG. 5 PRIOR ART
FIG. 5 is a schematic side elevation view of a prior art image forming apparatus.

FIG. 4 shows an alternative embodiment of the disclosed technologies, where the opposed cams 40*a*, 40*b* of the control apparatus 10*a* are actuated by separate motor and gear assemblies 50*a*, 50*b*. In this embodiment, two cam shafts are provided to couple the separate inboard and outboard sides, allowing them to be controlled and actuated independently.

Preferably in all the above embodiments, during operation one or more belt edge sensors 15 can measure at least the lateral position of the belt 2 with respect to the rollers. Once the belt 2 is measured to have drifted/walked beyond a threshold point toward either edge of the rollers, the actuating assembly 50 will be activated to tilt the steering roller 20 in the appropriate direction in order to compensate. Thus, the drive motor 51 would cause the cam shaft 42 to turn in one direction in order to pivot the steering roller 20 clockwise or the cam shaft 42 would be turned in the opposite direction in order to make it pivot counter-clockwise. Once the belt edge sensor(s) 15 detect the appropriate correction in the lateral position of the belt 2, the drive motor 51 could be reversed to bring the steering roller 20 back to a neutral position.

Preferably, the belt edge sensor(s) 15 communicate electronically with a controller that steers the belt in accordance with the disclosed technologies. The controller is designed to maintain a designated lateral position of the belt 2 by maintaining a threshold condition associated with the elements steering the belt 2. For example, the threshold condition could be a predetermined output voltage from the belt edge sensor (s) 15. Thus, preferably a belt edge sensor output voltage of approximately 2.4 volts is maintained. If an increase or decrease in the output voltage is detected, the controller sends a signal to the drive motor(s) 50, 50*a*, 50*b* to rotate in the proper direction in order for the belt edge sensor(s) 15 to achieve the desired voltage output (i.e., 2.4 volts). Alternatively, a certain tolerance or variation from the threshold condition could be tolerated without activating the steering system. Additionally, a fail-safe can be provided such that if, for any reason, the voltage should stray too far from the desired output, the system or at least a portion thereof will shut down. Thus, for example if the voltage were to reach one or more fail-safe values, such as an increase to 4.3 volts or decreases to 0.5 volts, the controller could shut down the system and declare a lateral belt position error. The fail-safe value(s) being predetermined based on design parameters of the printing system and/or the roller assembly. This could protect the belt 2 from getting damaged. Additionally, the controller could hold or store parameters of a position associated with the drive motor , the configuration of the actuating assembly and/or the roller assembly tilt. Such information could be held or stored, for example when the power is shut down from a machine power down (for example at the end of a work day or an impending machine service action). In this way, when the machine power resumes, the controller will return the drive motor to the stored position. For example, this could be achieved using the drive motor flag 55 and home sensor 57. This action would in turn position the steering support arms 30 back to where they were before the power was shut down.

Often printing systems include more than one printing module or station. Accordingly, more than one belt position control apparatus 10, 10*a* can be included in an overall printing system.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus for controlling a position of a belt in a printing system, wherein the belt is generally moveable in a process flow direction within the printing system, wherein a lateral direction extends substantially along the belt and substantially perpendicular to the process flow direction, the apparatus comprising:

a roller assembly for engaging at least a portion of the belt, the roller assembly extending laterally across the belt;

a pair of laterally spaced support arms each rotatably supporting opposed ends of the roller assembly, each support arm being pivotally coupled to the printing system for movement about a pivot axis extending substantially in the lateral direction; and an actuating assembly for pivotally moving at least one of the support arms about the pivot axis, whereby the pivotal movement pivots one support arm relative to the other, wherein the actuating assembly pivots both support arms in opposite directions about the pivot axis.

2. The apparatus of claim 1, further comprising:

said belt moveable in the process flow direction, the belt mounted on said roller assembly.

3. The apparatus of claim 1, wherein each of the support arms is engaged by a cam, the cams having an opposite profile to one another.

4. The apparatus of claim 3, wherein the cam engages a rotatable bearing member removeably secured to the support arm.

5. The apparatus of claim 3, wherein the cams are mutually secured to a rotatable cam shaft.

6. The apparatus of claim 3, wherein the cams are actuated independent of one another.

7. The apparatus of claim 1, further comprising:

a tensioning assembly for adjustably translating a longitudinal axis of the roller assembly at least one of toward and away from the pivot axis.

8. The apparatus of claim 1, wherein the at least one support arm pivotally movable by the actuating assembly being biased toward engagement with the actuating assembly.

9. The apparatus of claim 1, wherein the support arms each include at least one mounting slot for receiving a fastener to secure each support arm to the printing system, the mounting slot passing through the support arm.

10. An apparatus for controlling a position of a transfer belt in a printing system, the apparatus comprising:

a transfer belt for handling at least one of an image and a substrate media, the belt being generally moveable in a process flow direction within the printing system, wherein a lateral direction extends substantially along the belt and substantially perpendicular to the process flow direction;

a roller assembly for engaging at least a portion of the belt, the roller assembly extending laterally across the belt;

a pair of laterally spaced support arms each supporting opposed ends of the roller assembly, each support arm being pivotally supported allowing pivotal movement about a pivot axis extending substantially in the lateral direction;

a pair of rotating cams, each cam engaged with a portion of one of the support arms for pivotally moving the support arms, whereby rotation of the cams pivots at least one support arm relative to the other; and a motor assembly drivingly coupled to the pair of rotating cams for rotating the cams, the motor assembly selectively rotating the cams in one of two directions.

11. The apparatus of claim 10, wherein said transfer belt handles an image applied directly thereon for subsequent transfer to a substrate media.

12. A method of controlling a lateral position of a belt in a printing system, wherein the belt is generally moveable in a process flow direction within the printing system, wherein a lateral direction extends substantially along the belt and substantially perpendicular to the process flow direction, comprising:

detecting a threshold condition associated with at least one edge of the belt; and actuating at least one of two laterally spaced support arms for changing the lateral belt position, the support arms each supporting opposed ends of a roller assembly for engaging at least a portion of the belt, each of the support arms being pivotally supported allowing pivotal movement about an axis extending in the lateral direction, the actuation causing pivotal movement of the two laterally spaced support arms, whereby the pivotal movement rotates both of the support arms in opposite directions about the axis and tilts the roller assembly.

13. A method of controlling a lateral belt position of claim 12, wherein the actuating of the at least one of two laterally spaced support arms includes both support arms.

14. A method of controlling a lateral belt position of claim 12, wherein the threshold condition is determined from an output of a belt edge sensor.

15. A method of controlling a lateral belt position of claim 12, further comprising:

shutting down at least a portion of the printing system in response to the threshold condition reaching a fail-safe value.

16. A method of controlling a lateral belt position of claim 12, further comprising:

storing a parameter associated with at least one of a tilt position of the roller assembly, a position of a drive motor and a configuration of the actuating assembly.

17. A method of controlling a lateral belt position of claim 16, further comprising:

further actuating the at least one of two laterally spaced support arms, whereby at least one support arm is pivotally moved into a position associated with the stored parameter.

18. A method of controlling a lateral belt position of claim 16, wherein the stored parameter includes the configuration of the position associated with the drive motor.

* * * * *